US008396601B2

(12) United States Patent
Tomita et al.

(10) Patent No.: US 8,396,601 B2
(45) Date of Patent: Mar. 12, 2013

(54) ENERGY MANAGEMENT APPARATUS FOR CUSTOMERS

(75) Inventors: Yasushi Tomita, Mito (JP); Masahiro Watanabe, Hitachi (JP); Rena Tachihara, Tokyo (JP); Yuichi Otake, Kawasaki (JP); Tatsuya Yamada, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 204 days.

(21) Appl. No.: 12/850,234

(22) Filed: Aug. 4, 2010

(65) Prior Publication Data

US 2011/0035075 A1 Feb. 10, 2011

(30) Foreign Application Priority Data

Aug. 5, 2009 (JP) ..... 2009-182010

(51) Int. Cl.
*G01M 1/38* (2006.01)

(52) U.S. Cl. ..... 700/276; 700/278; 700/291

(58) Field of Classification Search ..... 700/276–278, 700/286, 291, 295
See application file for complete search history.

(56) References Cited

U.S. PATENT DOCUMENTS

| | | | | |
|---|---|---|---|---|
| 5,539,633 | A * | 7/1996 | Hildebrand et al. | 700/32 |
| 2003/0139854 | A1 * | 7/2003 | Kolk et al. | 700/291 |
| 2004/0238653 | A1 * | 12/2004 | Alles | 236/49.3 |
| 2007/0045431 | A1 * | 3/2007 | Chapman et al. | 236/46 C |

FOREIGN PATENT DOCUMENTS

| | | |
|---|---|---|
| JP | 2006-138621 | 6/2006 |

OTHER PUBLICATIONS

Critical Peak Pricing (CPP), Copyright 2009, Retrieved Jun. 5, 2009 from the Internet: URL:http://www.pge.com.mybusiness/energysavingsrebates/demandresponse/cpp/.

Automated Demand Response Program, Copyright 2009, Retrieved Jun. 5, 2009 from the Internet: URL:http://www.pge.com/mybusiness/energysavingsrebates/demandresponse/adrp/.

* cited by examiner

*Primary Examiner* — Mohammad Ali
*Assistant Examiner* — Nathan Laughlin
(74) *Attorney, Agent, or Firm* — Antonelli, Terry, Stout & Kraus, LLP.

(57) ABSTRACT

A customer-dedicated energy management apparatus includes an air-conditioner partial-road characteristics identification unit for creating air-conditioning partial-road characteristics by using air-conditioning operation achievement data in the past, an intra-room heat-capacity characteristics identification unit for creating intra-room heat-capacity characteristics by using the air-conditioning operation achievement data in the past, and intra-room state value data, an air-conditioning setting temperature calculation unit for determining an air-conditioning setting temperature by using the air-conditioning partial-road characteristics and the intra-room heat-capacity characteristics, the setting temperature being appropriate for implementing an air-conditioning power-consumption-amount suppression target value determined, and an air-conditioner control unit for controlling an air conditioner so that the setting temperature determined will be implemented.

2 Claims, 3 Drawing Sheets

ENERGY MANAGEMENT APPARATUS FOR CUSTOMERS

BACKGROUND OF THE INVENTION

The present invention relates to a customer-dedicated energy management apparatus for controlling the power consumption amount of such a customer as building into a target value by adjusting the air-conditioning of the customer.

If the power demand increases steeply because of such occasions as an increase in the air conditioner's temporary usage due to severely hot weather, there sometimes occurs a shortage of the power-supplying capability. In that case, countermeasures are sometimes taken to suppress the power consumption of the customer temporarily.

For example, as one method of such countermeasures, a utility enterpriser in the state of California of the United States offers a customer-dedicated program which is referred to as "Demand Response". This program includes several types. For example, a program referred to as "Critical Peak Pricing (CPP)" functions as follows: Incidentally, this program is the technology described in Critical Peak Pricing Program (CPP). [retrieved on Jun. 5, 2009]. Retrieved from the Internet: <URL: http://www.pge.com/mybusiness/energysavingsrebates/demandresponse/cpp/>.

Namely, a participant into this program makes a contract with the utility enterpriser in advance. Then, the participant receives the application of a preferential price in which the electric amount unit-price is set at an inexpensive rate. The utility enterpriser everyday determines whether or not the next day should be set as being a CPP event day. If the next day is determined as being the CPP event day, by the time of its previous day, the utility enterpriser notifies the participant that the next day is the CPP event day.

Next, the electric amount unit-price during an on-peak time-zone (i.e., 12:00 to 18:00) of the CPP event day is set at an expensive rate. On the participant side, a countermeasure is taken to suppress the power consumption amount by suppressing the usage of electric appliances during the on-peak time-zone of the CPP event day, e.g., by raising the setting temperature of an air conditioner. This countermeasure is taken in order to avoid the electric-price increase during the on-peak time-zone of the CPP event day, and to ensure the merit of an annual electric-price reduction brought about from the application of the preferential price during the other times.

In this CPP event, however, the adjustment of the electric-appliances usage on the participant side depends entirely on the manpower. This fact requires that, every time the CPP event occurs, this adjustment be made by taking advantage of the manpower. Accordingly, there has existed a problem that the operation to be done on the participant side is troublesome, and that an uncertainty about the power-consumption suppressing behavior becomes a matter of apprehension.

In view of this situation, a program which is referred to as "Auto Demand Response (Auto-DR)" has been offered. In this program referred to as Auto-DR, the processing ranging from the delivery of the CPP event to the electric-appliances control is automated as follows: Incidentally, this processing is described in Automated Demand Response Program. [retrieved on Jun. 5, 2009]. Retrieved from the Internet: <URL: http://www.pge.com/mybusiness/energysavingsrebates/demandresponse/adrp/>. Namely, on the utility enterpriser side, a server is set up which is designed for delivering a CPP event signal for notifying the participant side of the CPP event day via a communications infrastructure. Simultaneously, on the participant side, a device for receiving the CPP event signal is set up. Also, a system is set up which is designed for controlling the electric appliances in response to the CPP event signal, and in accordance with a CPP-event-addressing control logic determined in advance.

SUMMARY OF THE INVENTION

In the Auto-DR program described earlier, once the CPP-event-addressing control logic has been determined, there is no necessity for making the adjustment by taking advantage of the manpower every time the CPP event occurs. Consequently, the troublesome operation to be done by the participant is eliminated. Also, the power-consumption suppressing behavior is carried out automatically.

The power consumption amount caused by the electric appliances, however, is also influenced by weather situations such as temperature. This factor makes it uncertain whether or not the suppression of the power consumption amount based on the CPP-event-addressing control logic, and the effect on the electric-price reduction based thereon will be able to be ensured exactly as expected. Meanwhile, if, in order to make it certain to ensure this effect, a somewhat stronger suppression of the power consumption amount is carried out, a possibility of damaging the convenience and comfort of the user becomes a matter of apprehension.

It is an object of the present invention to provide a customer-dedicated energy management apparatus for allowing a setting temperature for achieving an air-conditioning power-consumption-amount suppression target value to be determined with a high accuracy in the case of suppressing the power consumption amount at the time of the CPP event occurrence, and allowing the power consumption amount to be controlled so that the influence exerted on the convenience and comfort of the customer will become its minimum.

It is another object of the present invention to provide the customer-dedicated energy management apparatus for taking into consideration influences exerted from such factors as intra-room structure, intra-room-arranged objects, and intra-room-present persons' number situation in the case of suppressing the power consumption amount at the time of the CPP event occurrence, and making it possible to reduce and lessen the influence exerted on the convenience and comfort of the customer.

In order to accomplish the above-described objects, the customer-dedicated energy management apparatus of the present invention includes an air-conditioner partial-road characteristics identification unit for creating air-conditioning partial-road characteristics by using air-conditioning operation achievement data in the past, an intra-room heat-capacity characteristics identification unit for creating intra-room heat-capacity characteristics by using the air-conditioning operation achievement data in the past, and intra-room state value data, an air-conditioning power-consumption-amount suppression target value calculation unit for determining an air-conditioning power-consumption-amount suppression target value, the power consumption amount being suppressed down to the suppression target value by making an air-conditioning adjustment at the time of a CPP event occurrence, an air-conditioning setting temperature calculation unit for determining an air-conditioning setting temperature by using the air-conditioning partial-road characteristics and the intra-room heat-capacity characteristics, the setting temperature being appropriate for implementing the air-conditioning power-consumption-amount suppression target value determined, and an air-conditioner control unit for controlling an air conditioner so that the setting temperature determined will be implemented.

According to the present invention, in a customer, the influences exerted from such factors as intra-room structure, intra-room-arranged objects, and intra-room-present persons' number situation are taken into consideration in the case of determining the suppression target value for suppressing the power consumption amount at the time of a CPP event occurrence. This feature allows the setting temperature for achieving the air-conditioning power-consumption-amount suppression target value to be determined with a high accuracy, thereby making it possible to reduce and lessen the influence exerted on the convenience and comfort of the customer.

DETAILED DESCRIPTION OF THE INVENTION

Figure 1:
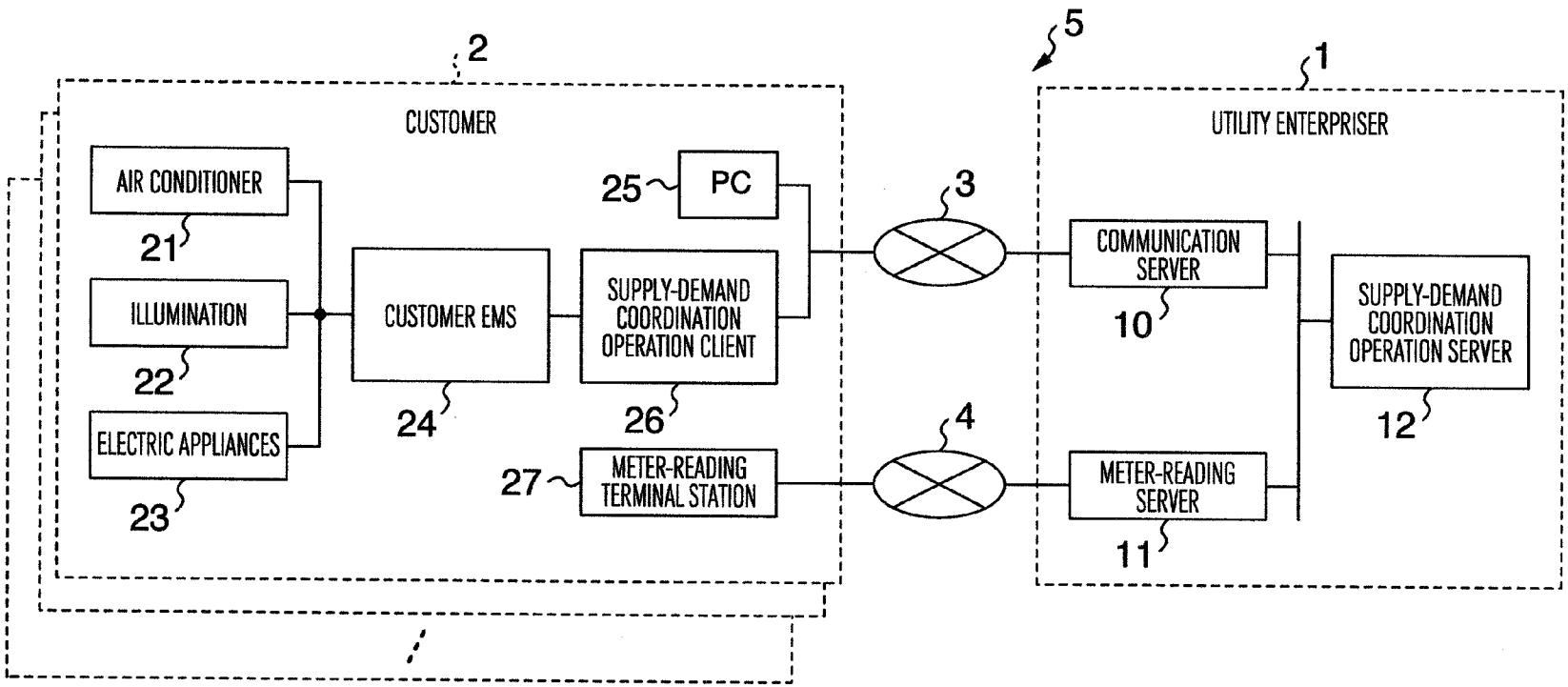
FIG. 1 is a configuration diagram for illustrating a supply-demand coordination operation apparatus according to an embodiment of the present invention.
Figure 2:
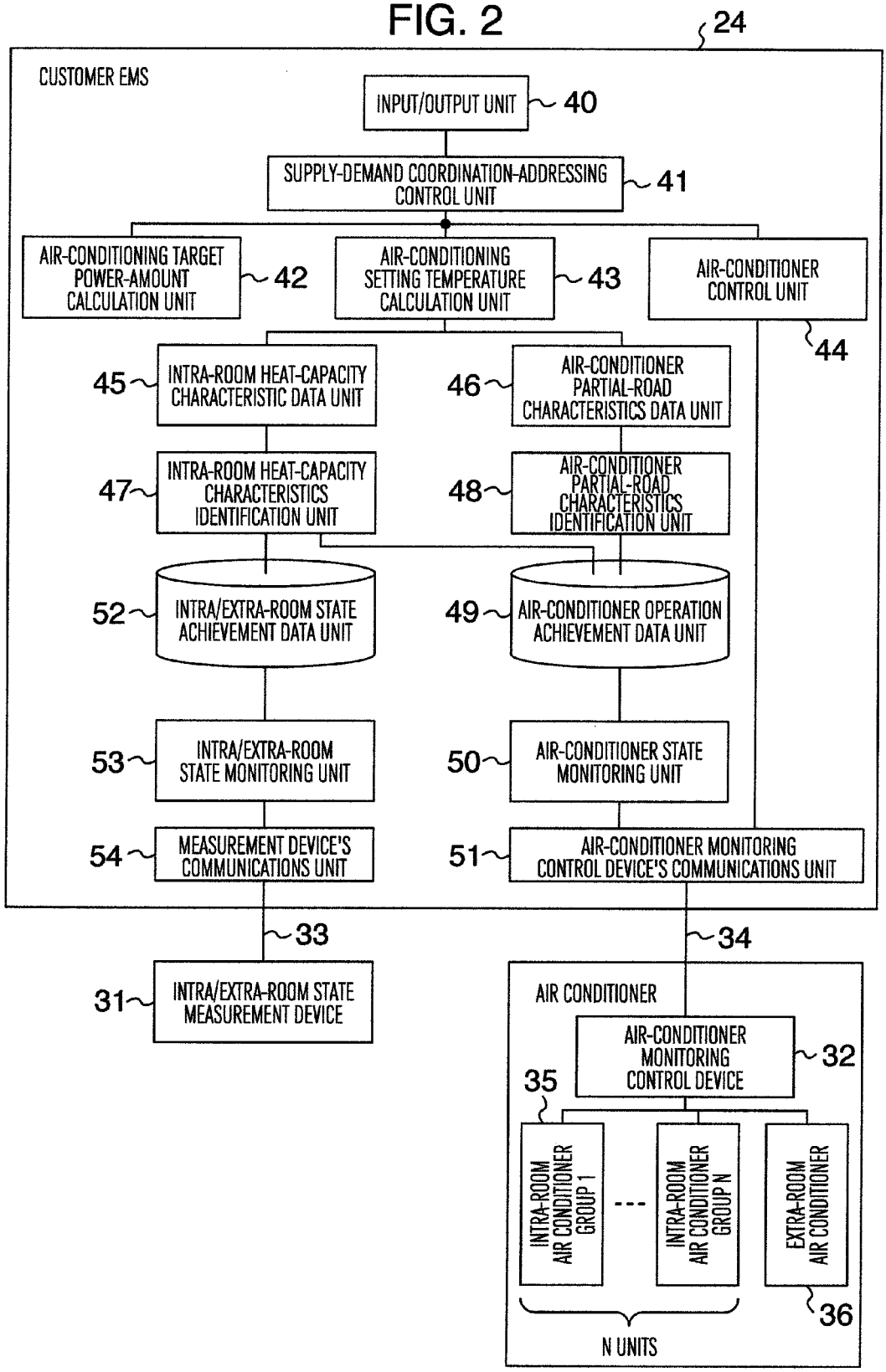
FIG. 2 is a functional block diagram for illustrating a configuration example of a customer EMS of the present embodiment.

Hereinafter, referring to FIG. 1 to FIG. 3, the explanation will be given below concerning an embodiment of the present invention. FIG. 1 is a configuration diagram for illustrating a supply-demand coordination operation apparatus according to the present embodiment.

As illustrated in FIG. 1, the supply-demand coordination operation apparatus 5 includes a power management device 1 which is set up on the side of a utility enterpriser for supplying the power to each customer, and a customer power operation device 2 which is set up on the side of each customer, and is connected the power management device 1 via communications networks 3 and 4.

The supply-demand coordination operation apparatus 5 is an apparatus for making a judgment as to whether or not the demand suppression is necessary, using such situations as supply-demand balance on the entire power supply line. Then, if the apparatus 5 judges that the demand suppression is necessary, the apparatus 5 delivers a demand-suppressing request (which, hereinafter, will be referred to as "DR event") signal to each customer via the communications network 3.

The customer power operation device 2 includes an air conditioner 21, an illumination 22, electric appliances 23, a customer EMS 24 (which is the abbreviation for customer Energy Management System), a supply-demand coordination operation client 26 connected to the customer EMS 24, a PC 25 (which is the abbreviation for Personal Computer) connected to the supply-demand coordination operation client 26, and a meter-reading terminal station device 27. Here, the air conditioner 21 and the illumination 22 are distinguished from the other electric appliances for convenience, although the air conditioner 21 and the illumination 22 themselves are also electric appliances.

The supply-demand coordination operation client 26 is a device for receiving the DR event signal from the utility enterpriser, and passing this signal to the customer EMS 24.

The customer EMS 24 is a device for controlling the air conditioner 21, the illumination 22, and the electric appliances 23 in accordance with the DR event signal that the customer EMS 24 has received. In the case of the air conditioner 21, the customer EMS 24 performs a change in the temperature setting and the ON/OFF control.

The PC 25 is a device, which is equipped with a keyboard and a display, performs the input of information needed for the controls over the electric appliances 23, and the output of the control results. The PC 25 performs the transmission/reception of information between the PC 25 and the power management device 1 via the supply-demand coordination operation client 26 and the communications network 3.

The meter-reading terminal station device 27 is a communications terminal station for collecting meter-reading data on a power amount meter set up in the customer, and transmitting the collected data to the utility enterpriser.

The power management device 1 includes a communications server 10 connected to the supply-demand coordination operation client 26 and the PC 25 via the communications network 3, a meter-reading server 11 connected to the meter-reading terminal station device 27 via the communications network 4, and a supply-demand coordination operation server 12 connected to the communications server 10 and the meter-reading server 11.

The communications server 10 manages the communications that each type of server on the utility-enterpriser side, such as the supply-demand coordination operation server 12, performs with the supply-demand coordination operation client 26 and the PC 25 of the customer power operation device 2 via the communications network 3. The meter-reading server 11 communicates with the meter-reading terminal station device 27 on the customer side via the communications network 4, thereby collecting the meter-reading data on the power amount meter of the customer. The collected data is recorded into a database.

Hereinafter, the detailed explanation will be given below concerning a case where the customer EMS 24 controls the air conditioner 21. FIG. 2 is a diagram for illustrating the configuration of the customer EMS 24.

The customer EMS 24 includes an input/output unit 40 for performing the input/output with the supply-demand coordination operation client 26, the air conditioner 21, the illumination 22, and the electric appliances 23, a supply-demand coordination-addressing control unit 41 connected to the input/output unit 40, an air-conditioning target power-amount calculation unit 42 connected to the supply-demand coordination-addressing control unit 41, an air-conditioning setting temperature calculation unit 43, an air-conditioner control unit 44, an intra-room heat-capacity characteristic data unit 45 connected to the air-conditioning setting temperature calculation unit 43, an air-conditioner partial-road characteristics data unit 46, an intra-room heat-capacity characteristics identification unit 47 connected to the intra-room heat-capacity characteristic data unit 45, an air-conditioner partial-road characteristics identification unit 48 connected to the air-conditioner partial-road characteristics data unit 46, an air-conditioner operation achievement data unit 49 connected to the intra-room heat-capacity characteristics identification unit 47 and the air-conditioner partial-road characteristics identification unit 48, an air-conditioner state monitoring unit 50 connected to the air-conditioner operation achievement data unit 49, an air-conditioner monitoring control device's communications unit 51 connected to the air-conditioner state monitoring unit 50 and the air-conditioner control unit 44, an intra/extra-room state achievement data unit 52 connected to the intra-room heat-capacity characteristics identification unit 47, an intra/extra-room state monitoring unit 53 connected to the intra/extra-room state achievement data unit 52, and a measurement device's communications unit 54 connected to the intra/extra-room state monitoring unit 53.

The customer EMS 24 is connected to an intra/extra-room state measurement device 31 via a communications line 33, and is connected to an air-conditioner monitoring control device 32 via a communications line 34.

The air-conditioner monitoring control device 32 monitors state values of intra-room air conditioners 35 and an extra-room air conditioner 36, then performing operation controls over the intra-room air conditioners 35 and the extra-room air conditioner 36. Namely, the air-conditioner monitoring control device 32 monitors the state values of the air conditioner, such as inlet air temperature, outlet air temperature, wind amount, air-conditioner power consumption amount, air-conditioning output, setting temperature, and setting wind amount of each intra-room air conditioner 35, and outer-atmosphere temperature on the periphery of the extra-room air conditioner 36. Then, using the state values of these air conditioners, the device 32 performs the controls, such as operation halt and cooling output of the intra-room air conditioners 35 and the extra-room air conditioner 36. Also, in some cases, the device 32 performs the controls by receiving instruction values such as temperature setting and wind amount setting. The intra/extra-room state measurement device 31 measures intra/extra-room state values, such as intra-room temperature and humidity, outer-atmosphere temperature and humidity, and intra-room-present persons' number. Here, the air-conditioning output refers to an eliminated heat amount at the time of cooling, and an added heat amount at the time of heating.

The air conditioner is constituted with and divided into the intra-room air conditioners 35 which are to be set up indoors, and the extra-room air conditioner 36 which is to be set up outdoors. The cooling operation is performed as follows: A coolant is compressed by a compressor installed on the extra-room air conditioner 36. Next, the coolant compressed is caused to adiabatically expand by an expansion valve of each intra-room air conditioner 35. Moreover, the coolant, whose temperature has become significantly lower, flows inside the heat exchanger. At this time, the coolant deprives absorbed air of its heat, thereby cooing the air. Finally, the resultant cool wind is flown into the room from the outlet of each intra-room air conditioner 35.

The extra-room air conditioner 36, in some cases, is set up in plural numbers. With respect to the plural numbers of intra-room air conditioners 35, however, their control such as temperature setting can only be performed in batch. Accordingly, the intra-room air conditioners are addressed in batch, and thus are referred to as "intra-room air conditioner group", including the case of one unit of air conditioner as well. Consequently, the cooling output from the entire air conditioner becomes equal to a value resulting from totaling the cooling outputs in the respective intra-room air conditioner groups.

The air-conditioner state monitoring unit 50 collects the state values of the air conditioner of the intra-room air conditioners 35 and the extra-room air conditioner 36 from the air-conditioner monitoring control device 32 via the air-conditioner monitoring control device's communications unit 51. Then, the unit 50 stores the air-conditioner operation achievement data into the air-conditioner operation achievement data unit 49. If the air-conditioning output cannot be collected, the calculation may be made using [(inlet air temperature−outlet air temperature)×wind amount] as an alternative value for the air-conditioning output.

The intra/extra-room state monitoring unit 53 collects the intra/extra-room state values, such as intra-room temperature and humidity, outer-atmosphere temperature and humidity, and intra-room-present persons' number, from the intra/extra-room state measurement device 31 via the measurement device's communications unit 54. Then, the unit 53 stores the intra/extra-room state values into the intra/extra-room state achievement data unit 52 as the intra/extra-room state achievement data.

The air-conditioner operation achievement data and the intra/extra-room state achievement data include the air-conditioner power consumption amount on each point-in-time cross section, the air-conditioning output (i.e., eliminated heat amount at the time of cooling, and added heat amount at the time of heating), the inlet air temperature, the outlet air temperature, the wind amount, the outer-atmosphere temperature, the setting temperature, and the setting wind amount of each intra-room air conditioner.

The air-conditioner partial-road characteristics identification unit 48 creates the air-conditioner partial-road characteristics data, using the air-conditioner operation achievement data stored into the air-conditioner operation achievement data unit 49 and the intra/extra-room state achievement data stored into the intra/extra-room state achievement data unit 52. As described above, the air-conditioner operation achievement data and the intra/extra-room state achievement data include the data including the air-conditioner power consumption amount on each point-in-time cross section, the air-conditioning output (i.e., eliminated heat amount at the time of cooling, and added heat amount at the time of heating), and the outer-atmosphere temperature.

The air-conditioner partial-road characteristics identification unit 48 determines an approximation expression on the basis of these pieces of achievement data. Here, the approximation expression is a one which approximates the power consumption amount, i.e., an objective variable, in such a manner that a plurality of variables including the air-conditioning output are selected as its explanatory variables. For example, it is conceivable that the approximation expression is determined as follows: The air-conditioning output and the outer-atmosphere temperature are selected as the explanatory variables. Next, a quadratic expression including the air-conditioning output and the outer-atmosphere temperature is assumed. Moreover, the coefficients of the quadratic expression are determined by taking advantage of a multivariable analysis.

The intra-room heat-capacity characteristics identification unit 47 creates the intra-room heat-capacity characteristic data, using the data on the air-conditioning output and the intra-room temperature stored into the air-conditioner operation achievement data unit 49 and the intra/extra-room state achievement data unit 52. For example, it is conceivable that the intra-room heat-capacity characteristic data is created as follows: A plurality of point-in-time cross sections, which are up to the past from the present point-in-time by the amount of a set time determined in advance, are selected as the target. Next, the air-conditioning output amount and the room-temperature change amount within a constant time predetermined in advance are determined. Moreover, the relationship expression between an air-conditioning output change amount and the room-temperature change amount on the point-in-time cross sections selected as the target is approximated by taking advantage of the method of least-squares on the assumption of a linear or quadratic expression. Finally, the relationship expression approximated is defined as the intra-room heat-capacity characteristic data at the present point-in-time. This intra-room heat-capacity characteristic data turns out to be the data in which the influences exerted from such factors as the intra-room structure, intra-room-arranged objects, and intra-room-present persons' number situation are taken into consideration.

The input/output unit 40 performs a processing of receiving the DR event signal from the supply-demand coordination operation client 26, and passing the DR event signal to the supply-demand coordination-addressing control unit 41.

The supply-demand coordination-addressing control unit 41 performs the following processing: When the unit 41 receives the DR event signal, the unit 41 receives an air-conditioning power-amount target value from the air-conditioning target power-amount calculation unit 42. Next, the unit 41 passes the air-conditioning power-amount target value that the unit 41 has received to the air-conditioning setting temperature calculation unit 43. Moreover, the unit 41 receives an air-conditioning setting-temperature target value calculated by the air-conditioning setting temperature calculation unit 43, then transmitting the air-conditioning setting-temperature target value that the unit 41 has received to the air-conditioner control unit 44.

In response to the inquiry from the supply-demand coordination-addressing control unit 41, the air-conditioning target power-amount calculation unit 42 calculates a total-power-amount suppression target value on the basis of the present value and future prediction value of the total power amount of the customer. Furthermore, the unit 42 calculates the air-conditioning power-amount target value on the basis of the present value and future prediction value of the air-conditioning power amount.

For example, it is conceivable that the total-power-amount suppression target value is calculated by setting the suppression ratio in advance, and using [total-power-amount suppression target value=total-power-amount present value× suppression ratio]. Also, it is conceivable that the air-conditioning power-amount target value is calculated by using [air-conditioning power-amount target value=max {air-conditioning power-amount present value−total-power-amount suppression target value, 0}].

The air-conditioning setting temperature calculation unit 43 determines an air-conditioning output corresponding to the air-conditioning power-amount target value calculated, and an air-conditioning output corresponding to the air-conditioning power-amount present value, using the air-conditioner partial-road characteristics data stored in the air-conditioner partial-road characteristics data unit 46. Moreover, the unit 43 calculates a difference between these air-conditioning outputs, then defining this difference as an air-conditioning output adjustment amount. The air-conditioner partial-road characteristics data, which is the data for establishing the correspondence between an air-conditioning output and the air-conditioning power amount at that time, has been created in advance by the air-conditioner partial-road characteristics identification unit 48 as described earlier.

Next, the air-conditioning setting temperature calculation unit 43 determines an intra-room temperature change amount, using the intra-room heat-capacity characteristic data stored in the intra-room heat-capacity characteristic data unit 45. Here, the intra-room temperature change amount corresponds to a heat amount which is to be eliminated from indoors or added to indoors by the above-described air-conditioning output adjustment amount. The intra-room heat-capacity characteristic data, which is the data for establishing the correspondence between the air-conditioning target intra-room increased/decreased heat amount and the intra-room temperature change amount, has been created in advance by the intra-room heat-capacity characteristics identification unit 47 as described earlier. Furthermore, the air-conditioning setting temperature calculation unit 43 subtracts the determined intra-room temperature change amount from the present room temperature, then outputting the resultant subtraction value as the air-conditioning setting-temperature target value.

The air-conditioner control unit 44 has received the air-conditioning setting-temperature target value from the supply-demand coordination-addressing control unit 41. In addition, the unit 44 transmits, as a setting-temperature change instruction, the air-conditioning setting-temperature target value to the air-conditioner monitoring control device 32 via the air-conditioner monitoring control device's communications unit 51. Having received the air-conditioning setting-temperature target value, the air-conditioner monitoring control device 32 controls the intra-room air conditioners 35 and the extra-room air conditioner 36 so that the air-conditioning setting-temperature target value will be implemented.

Based on the employment of the structure like this, the influences exerted from such factors as intra-room structure, intra-room-arranged objects, and intra-room-present persons' number situation are taken into consideration in the case of guiding the power suppression at the time of a CPP event occurrence. This feature allows the setting temperature corresponding to the air-conditioning power suppression amount to be determined with a high accuracy, thereby making it possible to reduce and lessen the influence exerted on the convenience and comfort of the customer.

Figure 3:
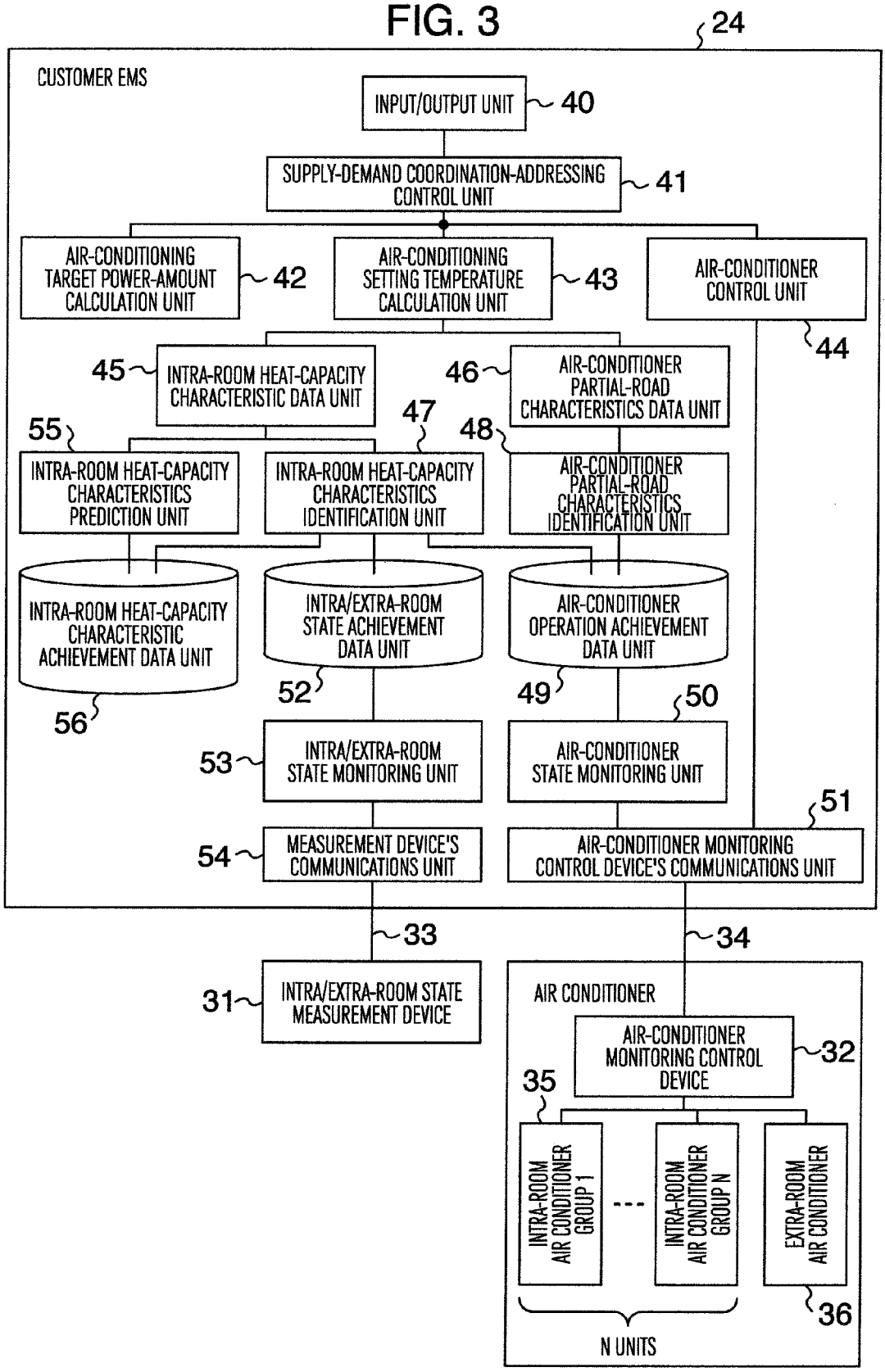
FIG. 3 is a functional block diagram for illustrating another configuration example of the customer EMS of the present embodiment.

FIG. 3 is a functional block diagram for illustrating another configuration example of the customer EMS 24. In this example, an intra-room heat-capacity characteristic achievement data unit 56 and an intra-room heat-capacity characteristics prediction unit 55 are added to the embodiment illustrated in FIG. 2. The intra-room heat-capacity characteristics prediction unit 55 is connected to the intra-room heat-capacity characteristic data unit 45, and the intra-room heat-capacity characteristic achievement data unit 56 is connected to the intra-room heat-capacity characteristics prediction unit 55 and the intra-room heat-capacity characteristics identification unit 47.

In addition to the intra-room heat-capacity characteristic data identified by the intra-room heat-capacity characteristics identification unit 47, the intra-room heat-capacity characteristic achievement data unit 56 stores and manages, for each point-in-time in the past, the data such as intra-room-present persons' number which influences the intra-room heat-capacity characteristic data.

The intra-room heat-capacity characteristics prediction unit 55 makes reference to the intra-room heat-capacity characteristics data in the past and the data such as intra-room-present persons' number. Based on these pieces of data, the unit 55 predicts and creates the intra-room heat-capacity characteristics data on a certain point-in-time cross section in the future. For example, it is conceivable that the intra-room heat-capacity characteristic data on a prediction-target point-in-time cross section can be determined as follows: A plurality of point-in-time cross sections, which are up to the past from the present point-in-time by the amount of a set time determined in advance, are selected as the target. Next, the relationship expression between the intra-room heat-capacity characteristic data and the intra-room-present persons' number is approximated by taking advantage of the method of least-squares on the assumption of a linear or quadratic expression. Moreover, the intra-room-present persons' number on the point-in-time cross sections in the future, which is supposed to be predicted, is predicted assuming that the intra-room-present persons' number is equal to the intra-room-present persons' number at the same point-in-time on the previous day. Furthermore, the intra-room-present persons' number predicted is substituted into the relationship expression determined earlier, thereby determining the above-described intra-room heat-capacity characteristic data.

In the present embodiment, the air-conditioning target power-amount calculation unit 42 calculates the air-conditioning power-amount target value at a future point-in-time. Also, the air-conditioning setting temperature calculation unit 43 calculates the air-conditioning setting-temperature target value at the future point-in-time, using the intra-room heat-capacity characteristics data at the future point-in-time. Subsequently, the supply-demand coordination-addressing control unit 41 causes the air-conditioning setting-temperature target value at the future point-in-time to be displayed on the input/output unit 40.

On account of the employment of the structure like this, when the customer has received the DR event signal, if there exists a time-zone during which a large setting-temperature relaxation width is displayed, the air-conditioning output is heightened a little earlier than this time-zone. This processing allows the heat amount to be eliminated from indoors at the time of cooling, and the heat amount to be added to indoors at the time of heating. As a consequence, it becomes possible to implement such countermeasures as suppression of the influence exerted on the intra-room environments during this time-zone.

The invention claimed is:

1. A customer-dedicated energy management apparatus, comprising:

an air-conditioner partial-road characteristics identification unit for determining an approximation expression by using air-conditioner power consumption amounts collected by an air-conditioner state monitoring unit, air-conditioning operation achievement data, and intra/extra-room state achievement data, said approximation expression approximating power consumption amount in such a manner that a plurality of variables including air-conditioning output are selected as its explanatory variables, said air-conditioning operation achievement data being air-conditioner state values including said air-conditioning output, said intra/extra-room state achievement data being collected by an intra/extra-room state monitoring unit, and being intra/extra-room state values including room temperature;

an intra-room heat-capacity characteristics identification unit for determining a relationship expression between an air-conditioning output change amount and a room-temperature change amount;

an air-conditioning target power-amount calculation unit for calculating an air-conditioning power-amount target value;

an air-conditioning setting temperature calculation unit for calculating an air-conditioning output adjustment amount from said air-conditioning power-amount target value calculated by said air-conditioning target power-amount calculation unit, and said approximation expression determined by said air-conditioner partial-road characteristics identification unit, said approximation expression approximating said power consumption amount such that said plurality of variables including said air-conditioning output are employed as said explanatory variables, and calculating an air-conditioning setting-temperature target value from said air-conditioning output adjustment amount calculated, and said relationship expression between said air-conditioning output change amount and said room-temperature change amount, said relationship expression being determined by said intra-room heat-capacity characteristics identification unit; and an air-conditioner control unit for controlling an air conditioner such that said air-conditioning setting-temperature target value calculated is selected as its instruction value.

2. The customer-dedicated energy management apparatus according to claim 1, further comprising:

an intra-room heat-capacity characteristics prediction unit for creating, from said intra-room heat-capacity characteristics data and data including intra-room-present persons' number, intra-room heat-capacity characteristics data on a prediction-target point-in-time cross section.

* * * * *